United States Patent [19]
Lapointe

[11] 4,317,544
[45] Mar. 2, 1982

[54] CHIPPER

[75] Inventor: Joseph A. Lapointe, Pointe Claire, Canada

[73] Assignee: Domtar Inc., Montreal, Canada

[21] Appl. No.: 111,806

[22] Filed: Jan. 14, 1980

[51] Int. Cl.[3] ..... B02C 16/08
[52] U.S. Cl. ..... 241/57; 144/176; 241/92
[58] Field of Search ..... 144/162 R, 176, 323; 241/68, 92, 60, 57, 58, 278 R, 47, 56, 93, 282.1

[56] References Cited

U.S. PATENT DOCUMENTS

| | | | |
|---|---|---|---|
| 3,069,101 | 12/1962 | Wexell | 241/92 |
| 3,392,763 | 7/1968 | Ledergerber | 241/92 X |
| 4,247,053 | 1/1981 | Lapointe | 241/92 X |

*Primary Examiner*—Mark Rosenbaum

[57] ABSTRACT

A chipper having improved means for separating debris from chips is formed by extending the chip slots radially outward beyond the effective cutting length of the knives and is provided with passage means to direct debris from within the chip slots into a front chamber on the infeed side of the disc. The front chamber is provided with a tangential outlet for debris and the chipper is provided with a separate tangential outlet for chips.

10 Claims, 7 Drawing Figures

CHIPPER

FIELD OF THE INVENTION

The present invention relates to a wood chipper. More specifically, the present invention relates to a chipper for chipping whole trees or portions thereof having improved means for separating debris from cut chips.

PRIOR ART

Considerable effort has been applied to improvement of equipment for chipping whole trees or portions thereof i.e. chipping of the bole together with the branches leaves, needles, etc. and quite recently the number of such chippers in commercial operation in Canada and the United States has increased significantly due to the advent of a Debris Separating Chipper such as that illustrated in U.S. Pat. No. 4,159,083 issued May 26, 1979 to J. A. Lapointe. The modified chipper disclosed in this patent includes a front and a rear chamber on opposite sides of the chipper disc, separate outlets from each of these chambers and means for positively ejecting the material from these chambers. It was found that the use of this equipment significantly reduced the amount of debris in the chips and permitted the use of whole tree chips by pulp mills both from a quality and a handling point of view. The operation of paddles as the means for rejecting debris causes air flow out through this debris outlet which tends to entrain some of the debris and facilitates its removal.

The device in the Lapointe patent significantly improved the operation of whole tree chippers, however, Lapointe proposed a further improvement using air flow through the knife slot into the debris chamber to inhibit the flow of debris through the knife slot into the chip chamber. Such a device is disclosed in U.S. Pat. No. 4,247,053 issued Jan. 27, 1981 by Lapointe (Canadian patent application No. 311,935, filed Sept. 22, 1978 by Lapointe).

BROAD DESCRIPTION OF THE INVENTION

It is the object of the present invention to further improve the operation of either of the above devices and improve the separation and rejection of debris such as foliage, dirt and grit and the like out of the debris outlet.

Broadly the present invention relates to a debris separating chipper comprising a housing, a disc mounted for rotation in said housing, a front chamber and a rear chamber in said housing, a chip outlet from said rear chamber and a debris outlet from said front chamber, a feed inlet for directing wood to be chipped longitudinally into said chipper, said disc having a cutting face, said cutting face forming one wall of said front chamber, at least one knife on said cutting face, said knife having an effective cutting length sweeping said inlet in a position to cut said wood, a slot in said disc leading said knife in a position to receive chips cut by said knife and directed through said slot, a passage means extending radially outwardly beyond the radial outer most end of said effective cutting length of said knife connecting said slot with said front chamber so as to direct material travelling in said slot toward the periphery of said disc out of said slot and into said front chamber.

BRIEF DESCRIPTION OF THE INVENTION

Further features, objects and advantages will be evident from the following detailed description of the preferred embodiments of the present invention.

DETAILED DESCRIPTION OF THE PREFERRED EMBODIMENTS

Figure 1:
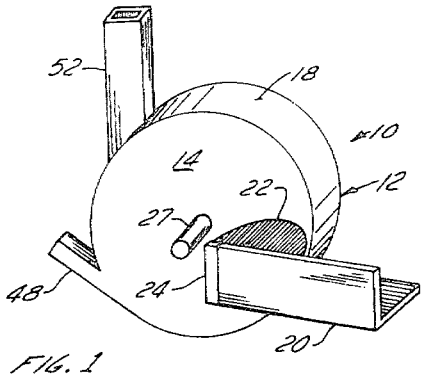
FIG. 1 is an isometric view with parts omited of a chipper incorporating the present invention.

As shown in FIG. 1, the chipper 10 is composed of a housing 12 having a front wall 14, a rear wall 16, and a peripheral wall 18. A feed spout or inlet 20 is provided at the front wall 14 for directing logs or whole trees longitudinally into the chipper through the chipper opening 22. A suitable anvil 24 is provided at the end of the spout 20 adjacent the front wall 14 on the downstream side of the spout 20 in the direction of rotation of the chipper disc 26 which is mounted within the housing 12 on shaft 27 and divides the housing into a front chamber 28 and a rear chamber 30 (see FIG. 3 and 4). Preferably an annular partition wall 32 projects radially inward from the peripheral wall 18 toward and is received within the circumfrontal groove 33 in the disc 26. The partition 32 ensures isolation of the front chamber 28 from the rear chamber 30 i.e. the wall 32 extends completely around the circumference of the disc 26 and the peripheral wall 18 to inhibit the movement of material from the front chamber to the rear chamber. Obviously a close fit between the periphery 34 of the disc 26 and the inner surface of the peripheral wall 18 would also tend to isolate the front chamber 28 from the rear chamber 30.

Figure 3:
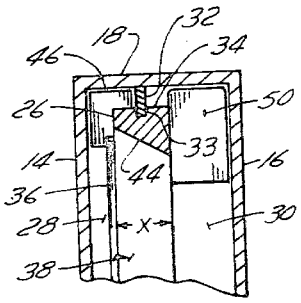
FIG. 3 is a section along the lines 3—3 of FIG. 2 with the disc in the housing.

The disc in the illustrated arrangement, particularly FIG. 3, is provided with three knives 36 each of which is provided with a chip slot 38 leading from the front chamber 28 axially of the chipper disc 26 to the rear chamber 30 i.e. parallel to the axis of rotation of the disc to the rear chamber 30.

Each of the chip slots 38 has a portion extending radially outward beyond the effective cutting length of the knives as indicated at 42 of the knife 36 adapted to provide a passage 40 connecting the slot 38 to the front chamber 28. The term "effective cutting length" of the knife as used herein is intended to mean the portion of the knife that sweeps the inlet or spout 20 in a position to cut the logs or wood being fed to the chipper i.e. the effective cutting length of the knife is usually less than the overall length of the blades or knife so that each knife 36 extends a short distance radially outward beyond its effective cutting length. The passage 40 which extends beyond the radially outward end of the effective cutting length of the knife forms a passage leading to the front chamber and is provided with a deflector in the form of a surface 44 which deflects the leaves, foilage or other debris from the slot 38 into the front chamber 28. Suitable means in the form of paddles 46 (three shown) mounted on the front face of and in the illustrated arrangement projecting around the periphery 34 of the disc 26 provide means for ejecting debris, etc., through the debris outlet 48 which preferably will be tangential and extend through the peripheral wall 18 as illustrated in FIG. 1.

Figure 2:
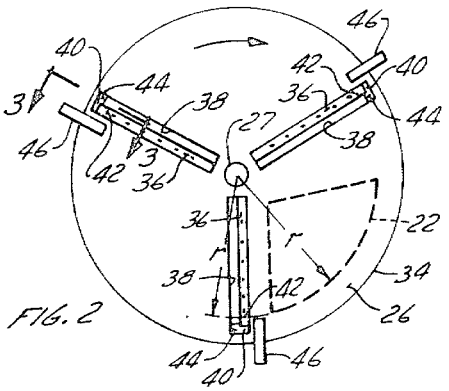
FIG. 2 is a face-on-view of the cutting face of a disc incorporation the present invention.

The outer radial extremity of the effective cutting length of the cutting blades 36 as indicated at 42 is equivalent to the radius r which is the maximum radius of the sweep of the knife across the inlet spout 20 i.e. across the opening 22 into the chamber which has been indicated in dot/dash lines in FIG. 2. This radius r designates the spacing of the radial extremity of the effective cutting length of the knife from the axis of rotation of the chipper disc and the beginning of the portion 40 forming the passage to the front chamber 28.

The rear face of the disc 26 is provided with paddles 50 (only one shown FIG. 3) to eject the chips that pass through the slot 38 out through the tangential chip outlet 52 which preferrably for chippers used in the bush will be a tangential outlet through the peripheral wall 18 as illustrated in FIG. 1.

It will be noted that the chip outlet and debris outlet are staggered in direction of rotation of the disc i.e. if the disc rotates in a clockwise direction with the inlet spout in the four to six o'clock position as illustrated the debris outlet 48 is at about the six to eight o'clock position and the chip outlet at the ten o'clock position i.e. the chip outlet leads the debris outlet in a direction of the rotation so that each slot 38 traverses the debris outlet 48 before the chip outlet 52. This is to ensure that the debris has an opportunity to leave the housing before the respective slots 38 traverse the chip outlet 52.

Proper positioning of the debris outlet relative to the chip outlet can improve the operation of the chipper, particularly the separation of debris from the chips. Staggering these two outlets as illustrated permits the debris in the front chamber to be ejected before the chips slot passes the chip outlet. As the slots 38 pass the debris outlet 48, and the chip outlet 52, air tends to be moved from in and, adjacent the slot torward the outlet being passed. Any increased movement of air through the slot 38 into the chips chamber may carry with it debris and thus ejecting the debris before the slot 38 reaches the chip outlet 52 reduces the possibility for debris to be carried by such air movement. Similarly, air movement from the chip chamber into the front chamber through the slots 38 will inhibit movement of debris through the slot into the chip chamber.

The debris outlet should be positioned to permit debris to move directly out of the front chamber without a complete traverse around the circumference of the debris or front chamber. However, the trajectory of this debris across the front face of the disc will vary depending on where the debris is engaged by the front face of the disc or by the knife and thus may not reach the outer periphery at the location of the debris outlet. In any event the chipper arrangement illustrated having the infeed or spout 20 in the lower right hand quadrant and the debris outlet 48 (as above described) in the first quadrant leading the anvil in the direction of the rotation of the disc and before the slot 38 traverses the chip outlet 52 is preferred.

Preferably the chip outlet 52 will extend substantially vertical so that an extension from the chip outlet for conveying the chips to waiting vans or the like may be turned using a rotating elbow having its axes of curvature substantially horizontal to deflect the chips in the required direction. With this arrangement the chips ride above the air in the extension i.e. centrifugal force will direct the chips towards one side of the air stream in the elbow with the chips being at the outside (maximum radius) of the elbow so that after the chips change their trajectory and travel substantially horizontally, they fall down into the main air stream.

In the FIGS. 1 to 3 embodiments the operation is as follows. Whole trees or portions thereof are fed via the infeed spout 20 and are cut via the knives 36 into chips, while some of the debris such as foliage, leaves, needles, branches, etc. fall or are drawn into the front chamber. This debris moves on the trajectory along the front face of the disc 26 towards the periphery thereof (much of the debris is at or adjacent the bottom of the spout 20 and is therefore adjacent the periphery of the disc when it enters the front chamber in the chipper illustrated) and, as above described, preferably is ejected directly out of the outlet 48. Chips on the other hand pass through the slot 38 into the rear chamber 30 and are ejected through the outlet 52.

Each of the slots 38 has a passage 40 extending beyond the radial outer end 42 of the effective cutting length of its knife 36 leading into the front chamber 28. Each passage 40 is provided with a slopped deflecting surface 44 sloping radially outward and toward the front chamber 28 to deflect debris contained within each slot 38 out of the slot 38 through the passage 40 and into the front chamber 28.

It has been found in the operation of a chipper such as that defined in the above referred to U.S. patent and patent application, the debris such as foliage has velocity through the slot in a direction axially of the chipper slower than the chips, and this debris it is believed tends to decelerate in the axial direction more quickly than the cut chips and to have a radial velocity component, imported thereto by centrifugal force, significally higher than the axial component. As a result this debris tends to move radially outward along the slot 38 and become packed into a mass at the outer radial extremity of the slot. In the prior art chippers this mass of material was moved into the chip chamber by the chips formed by the next cut on the log. The passage 40 provides an outlet through which this debris that tended to pack in the slot 38 is positively moved by centrifugal force. The debris travelling substantially radially of the disk contacts the deflecting surface 44 and is deflected as it travels through the passage 40 into the front chamber 28 and is probably ejected through the debris outlet 48 before the next cut is made by the knife 36.

Obviously the thickness in the disc i.e. dimension X of the slot 38 in the axial direction of the disc 26 defines in part the amount of material that will travel radially outward along the slot 38 and enter the passage 40 where it is deflected by the sloped section 44 into the front chamber. In some cases, it may be desirable and practical depending on the diameter of the disc, speed of rotation etc., to extend this slot 38 toward the chip chamber to increase the time for the debris to be moved radially and thereby to better ensure ejection of the debris into the front chamber i.e. by providing more time for centrifugal force to act to move the debris into passage 40. If the disc is thin this further residence time in the slot 38 may be provided by suitable axial extensions of the slots 38. There is obviously a maximum limit for the length X since it must be short enough to permit the chips to move substantially axially therethrough into the chip chamber without being deflected by face 44 into the front chamber.

Figure 4:
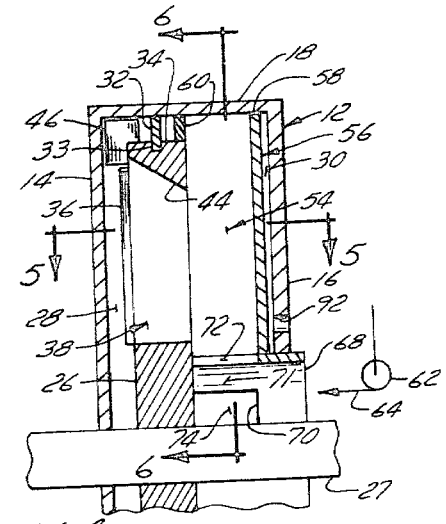
FIG. 4 is a view similar to FIG. 3 but extended to the axis of the rotation of the chamber and showing a modification of the present invention.
Figure 6:
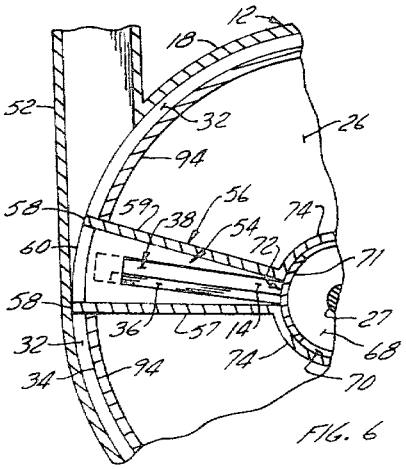
FIG. 6 is a partial section along the line 6—6 of FIG. 4.
Figure 5:
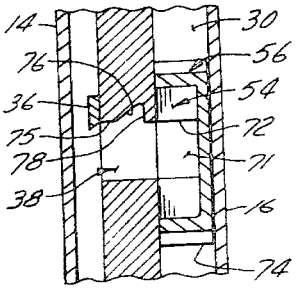
FIG. 5 is a partial section along the line 5—5 of FIG. 4.

FIGS. 4, 5 and 6 embodiment is very similar to the previous embodiment with the exception that the chip slots 38 do not lead directly into the rear chamber 30 rather they each empty into a chip pocket 54 provided on the rear face of the disc 26 and in direct communication with the slot 38. Each chip pocket 54 is contained within the chip chamber 30 and may be formed by a U-shaped housing 56 having legs 57 and 59 (see FIG. 6) secured to the back face of the disc 26. The outer end edges 58 of the U-shaped housing 56 are positioned in close proximity to the inner face of the peripheral wall 18 to seal the ends of the pockets 54 until they come in contact with the tangential chip outlet 52. To ensure this seal, a further wall 60 projecting radially outward from the peripheral edge 34 of the disc 26 may be provided to seal the fourth or remaining side of the chamber 54 to the peripheral wall 18 of the housing or the legs 57 and 59 of the U-shaped housing 56 may be extended over the periphery 34 of the disc 26 to seal against the partition wall 32.

Preferably in this arrangement, a suitable means 62 will be provided to blow air via line 64 into a central passage 68 cut out as indicated at 70 in the appropriate locations to provide communication for the flow of air out of the chamber 68 into the pocket 54 via the apertures 72 formed at the inner radial end of each of the pockets 54. The cut out 70 in the areas between the pockets 54 i.e. between apertures 72 may be closed by a suitable ring member indicated at 74 (FIGS. 4, 5 6 and 7) on the disc 26. The ring member 74 interconnects the inner radial ends of the housings 56.

In the FIGS. 4, 5 and 6 embodiment the slot 38 has been also modified to have an undercut space 76 into which debris may be driven by the rotational action of the disc.

The operation of FIGS. 4, 5 and 6 embodiments is essentially the same as the FIGS. 1 to 3 embodiment with the exception that air under pressure is injected into the chip pockets 54 and flows out through the slot 38 into the front chamber 28 and is ejected through the debris outlet 48 and the infeed aperature 22. The masked off area i.e. where the wall of the passage 68 is not cut out as indicated at 71 in FIGS. 4 and 6 is in the area where the radial outlet of the pocket 54 and the tangential chip outlet 52 are in direct communication so that air is not blown directly through the pocket 54 and out the tangential outlet 52 (see FIG. 5). Such direct communication coupled with the pumping action of the pocket as it rotates with the disc 26 could limit the air available from passage 68 to other pockets 54 or require supplying an additional amount of air.

The undercut area 76 provides a space into which the debris may travel or be driven by the action of the rotating disc and the rear wall 78 of this undercut tends to inhibit movement of debris within the undercut 76 axially of the disc 26 toward and into the chip chamber 54. A suitable step 75 may be provided adjacent the knife 36 to better ensure chips do not move into the undercut area 76. Obviously this undercut area 76 could also be used in the FIGS. 1 to 3 embodiment to further improve the operation.

Figure 7:
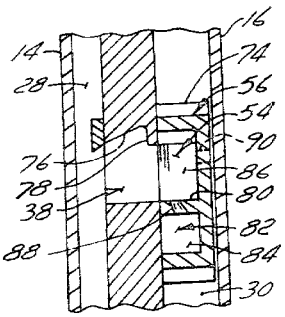
FIG. 7 is a view similar to FIG. 5 showing a further modification of the present invention.

In the arrangement shown in FIG. 7 the housing 56 forming the chamber 54 is divided by a partition wall 80 into a plenum 82 separate from the chip chamber 54. In this arrangement the bottom of plenum 82 i.e. the minimum radial end of the plenum is opened as indicated at 84 to provide communication through the slot or cut out 70 with the air duct 68 and the bottom of the chip pocket 54 may be closed as indicated at 86 or alternatively air may be fed directly into the pockets or chip chambers 54 via radial holes (not shown) through the walls 86. Obviously the areas between the openings 84 are closed off by the ringmember 74. Thus, air is injected into the plenum 82 via the opening 84 and the end of the plenum 82 adjacent the other periphery of the disc is sealed by a suitable partition (not shown) so that air can only escape from the plenum 82 via the nozzle 88 extending through the wall 80. This nozzle preferably extends the length of the slot 38 less the portion forming the passage 40 i.e. the effective cutting length of the knife 36 and is aimed to direct air into the slot 38 and tend to drive material such as leaves and the like toward the undercut area 76.

The operation of the FIG. 7 embodiment is essentially the same as FIG. 5 embodiment with the exception that instead of the air being injected directly into the pockets 54 it is injected into the plenum 82 and from there out through the nozzle 88 into the passage or slot 38.

To facilitate the build-up of air in the chip pocket 54 i.e. to replenish the air pumped out of the chip pocket 54 as it traverses the chip outlet 52, suitable aperatures such as those indicated by dotted lines at 90, may be provided. Preferably these apertures 90 will be adjacent the inner peripheral end of the chip pocket 54 i.e. adjacent the bottom 86 and suitable holes 92 shown for convenience in FIG. 4 only (they are not required for the FIG. 4 embodiment) will be provided in the back wall 16 to permit the egress of air into the holes 90. Obviously, if air is induced into the rear chamber 30 by suitable holes 92 through the back wall 16 and if the pumping action of the disc is to be reduced the passages between the pockets 56 must be closed off. This may be done for example by a peripheral flange extending circumferentially of the disc interconnecting the adjacent housings 56 at a point radially outward of the holes 92 such as the flange 94 illustrated in FIG. 6. This flange 94 extends between the disc 26 and the new wall 16.

It is noted that the face 44 in the illustrated embodiment is sloped to deflect debris directly from the slot 38 into the front chamber. This face 44 obviously could be slopped in the opposite direction provided the outlet from the passage 40 from the slot 38 is in front of the partition 32 i.e. if the partition 32 is moved to the right and suitable flanging and sealing mechanism provided this deflection could be a rearward instead of forwarded into the chamber 28. In any event this passage 40 must always empty into the front chamber 28 that communicates with the debris outlet 48. The preferred and easier construction the device is as illustrated.

Modifications may be made without departing from the spirit of the invention as defined in the appended claims.

I claim:

1. A debris separating chipper comprising; a housing, a rotatable disc mounted in said housing for rotation on an axis of rotation, a front chamber and a rear chamber in said housing, a chip outlet from said rear chamber and a debris outlet from said front chamber, a feed inlet for directing wood longitudinally into said chipper through said front chamber, said disc having a cutting face, said cutting face forming one wall of said front chamber, at least one knife on said cutting face, said knife having an effective cutting length sweeping said feed inlet in a position to cut wood fed through said feed inlet, a slot in said disc leading said knife in a position to receive chips cut by said knife and permit them to pass through said slot, passage means extending radially outward beyond an end of said effective cutting length of said knife remote from said axis of rotation, said passage connecting said slot with said front chamber means in said passage to deflect material travelling through said passage into said front chamber for ejection through said debris outlet.

2. A chipper as defined in claim 1 wherein said debris and chip outlets are substantially tangential and further comprising, paddle means mounted on said cutting face and in said front chamber, said paddle means ejecting debris from chamber through said debris outlet.

3. A chipper as defined in claims 2 wherein said means to deflect comprises a deflector surface in said passage to deflect said material travelling substantially radially in said slot into said front chamber.

4. A chipper as defined in claim 3 further comprising, chip pockets mounted on said disc, there being one chip pocket for each said slot, said chip pocket being in direct communication with said slot for receiving chips cut by said knife.

5. A chipper as defined in claim 4 further comprising, means for directing said air into said chip pocket and through said slot into said front chamber.

6. A chipper as defined in claim 1, 3 or 4 further comprising, a plenum formed on said chipper in advance of each of said chip slots, nozzle means from each of said plenum for directing air from said plenum through said slot into said front chamber, and means for moving air from said plenum and through said nozzles.

7. A chipper as defined in claim 1, 2 or 3 further comprising, means for moving air through said slot into said front chamber.

8. A chipper as defined in claim 1, 2 or 3 further comprising, partition means projecting radially inward from a circumferential wall of said housing toward a circumferential edge of said disc and providing a partition separating said front chamber from said rear chamber.

9. A chipper as defined in claims 1, 2 or 3 wherein said chip outlet is circumferentially spaced from said debris outlet and leads said debris outlet in the direction of rotation of said disc moving from said feed inlet

10. A chipper as defined in claims 1, 2 or 3 wherein said chip outlet is circumferentially spaced from said debris outlet and leads said debris outlet in the direction of rotation of said disc moving from said feed inlet so that air tends first to be drawn from said slot toward said front chamber and then from said slot toward said chip outlet as said slot traverses said debris and chip outlets respectively .

* * * * *